US010051985B2

(12) United States Patent
Jones

(10) Patent No.: US 10,051,985 B2
(45) Date of Patent: Aug. 21, 2018

(54) SHOWER ROD

(71) Applicant: Moen Incorporated, North Olmsted, OH (US)

(72) Inventor: Kyle Clancy Jones, Avon, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 15/600,933

(22) Filed: May 22, 2017

(65) Prior Publication Data

US 2017/0332818 A1 Nov. 23, 2017

Related U.S. Application Data

(60) Provisional application No. 62/340,200, filed on May 23, 2016.

(51) Int. Cl.

| | |
|---|---|
| ***A47B 23/04*** | (2006.01) |
| ***A47H 1/02*** | (2006.01) |
| ***A47K 10/04*** | (2006.01) |
| ***A47H 1/122*** | (2006.01) |
| ***A47H 1/022*** | (2006.01) |
| ***A47H 1/142*** | (2006.01) |
| *A47H 1/00* | (2006.01) |
| *A47H 1/04* | (2006.01) |

(52) U.S. Cl.

CPC ..... *A47H 1/122* (2013.01); *A47H 1/022* (2013.01); *A47H 1/142* (2013.01); *A47H 2001/003* (2013.01); *A47H 2001/0205* (2013.01); *A47H 2001/0215* (2013.01); *A47H 2001/045* (2013.01)

(58) Field of Classification Search

CPC ..... A47H 1/122; A47H 1/022; A47H 1/142; A47H 2001/003; A47H 2001/0205; A47H 2001/0215; A47H 1/02; A47H 2001/045; A47H 1/08; A47H 1/12; A47H 1/24; A47H 1/44; A47K 3/38; A47K 3/28; A47B 46/00; A47F 5/08; A47F 5/10

USPC .... 211/105.1–105.6, 123, 2, 16, 88.04, 175; 248/261–265, 251; 4/610, 558

See application file for complete search history.

(56) References Cited

U.S. PATENT DOCUMENTS

| | | | | | |
|---|---|---|---|---|---|
| 2,890,799 | A * | 6/1959 | Rosenbaum | A47H 1/08 | 16/87.4 R |
| 3,204,898 | A | 9/1965 | Manning | | |
| 3,580,397 | A | 5/1971 | Triplett | | |
| 4,229,842 | A * | 10/1980 | Gilmore | A47K 3/38 | 4/558 |
| 5,044,418 | A * | 9/1991 | Donahue | A47H 1/02 | 160/134 |
| 5,263,594 | A * | 11/1993 | Bianchi | A47H 1/06 | 16/96 R |
| 5,678,704 | A * | 10/1997 | Deeds | A47H 1/00 | 160/330 |
| 6,216,287 | B1 | 4/2001 | Wise | | |
| 6,263,523 | B1 | 7/2001 | Moore | | |
| 6,643,974 | B2 | 11/2003 | Ruiz et al. | | |
| 6,688,479 | B2 * | 2/2004 | Nei | A47H 1/022 | 211/105.2 |
| 6,694,543 | B2 * | 2/2004 | Moore | A47H 1/022 | 248/261 |
| 7,346,940 | B1 | 3/2008 | Liao | | |

(Continued)

*Primary Examiner* — Jennifer E. Novosad

(74) *Attorney, Agent, or Firm* — Calfee, Halter & Griswold LLP

(57) ABSTRACT

A shower rod that can be moved between a straight position and curved positions.

20 Claims, 15 Drawing Sheets

(56) References Cited

U.S. PATENT DOCUMENTS 7,762,508 B2 7/2010 Xu
7,958,577 B2 6/2011 Chang
8,015,633 B2 9/2011 Ho
8,069,508 B2 12/2011 O'Connell
8,146,182 B2 4/2012 Bauer
8,166,583 B1 5/2012 Liang
8,205,760 B2 6/2012 Chang
8,215,501 B2 * 7/2012 Trettin ..... A47K 3/38 211/105.2
8,528,753 B2 9/2013 Wooley, II
8,800,072 B2 8/2014 Chang
8,869,999 B2 10/2014 Lindo et al.
8,978,228 B2 * 3/2015 Didehvar ..... A47K 3/38 211/123
8,991,625 B2 3/2015 Bucklew et al.
9,033,163 B2 5/2015 Hsu
9,044,115 B1 6/2015 Chirigotis
9,271,592 B2 * 3/2016 Didehvar ..... A47H 1/022
2005/0268394 A1 * 12/2005 Monk ..... A47K 3/38 4/558
2007/0174956 A1 8/2007 Heaslip
2008/0115265 A1 * 5/2008 Heaslip ..... A47K 3/38 4/610
2008/0184479 A1 * 8/2008 Bathurst ..... A47K 3/38 4/610
2010/0186161 A1 7/2010 Wong
2011/0000051 A1 1/2011 Liang
2011/0047693 A1 3/2011 Bauer et al.
2012/0110729 A1 * 5/2012 Baines ..... A47K 3/38 4/610
2012/0167368 A1 * 7/2012 Napier ..... A47K 3/38 29/428
2014/0131298 A1 5/2014 Didehvar et al.
2015/0034581 A1 * 2/2015 Hsu ..... A47H 1/122 211/105.3
2015/0297038 A1 10/2015 Vaccaro
2016/0150904 A1 * 6/2016 Amos ..... A47H 1/122 160/368.1
2017/0013990 A1 * 1/2017 Amos ..... A47H 1/022
2017/0332818 A1 * 11/2017 Jones ..... A47H 1/122

* cited by examiner 10
10
10

SHOWER ROD

CROSS-REFERENCE TO RELATED APPLICATION

This application claims the benefit of U.S. Provisional Application No. 62/340,200, filed May 23, 2016, the entire disclosure of which is hereby incorporated by reference.

FIELD

The present invention relates generally to a shower rod, and, more particularly, to a shower rod that can be moved between a straight position and curved positions.

BACKGROUND

The installation and use of straight and curved shower rods can pose challenges. A shower rod that overcomes these challenges is desired.

SUMMARY

The present invention provides a shower rod that can be moved between a straight position and curved positions.

In an exemplary embodiment, the shower rod includes a rod assembly, a first mount/pivot assembly, and a second mount/pivot assembly. The rod assembly includes a first rod portion and a second rod portion. The first rod portion is flexible. The second rod portion is flexible. The second rod portion is operable to slide relative to the first rod portion. The first mount/pivot assembly includes a first mount portion and a first pivot portion. The first mount portion is operable to fixedly mount to a first mounting surface. The first pivot portion is operable to fixedly attach to the first rod portion. The first pivot portion is operable to pivot relative to the first mount portion. The second mount/pivot assembly includes a second mount portion and a second pivot portion. The second mount portion is operable to fixedly mount to an opposed second mounting surface. The second pivot portion is operable to fixedly attach to the second rod portion. The second pivot portion is operable to pivot relative to the second mount portion. The rod assembly is operable to move between a straight shape, a curved outward shape, and a curved inward shape. When the rod assembly is in the straight shape, the first rod portion and the second rod portion are mounted relative to the first mount portion and the second mount portion in a first position. When the rod assembly is in the curved outward shape, the first rod portion and the second rod portion are mounted relative to the first mount portion and the second mount portion in a second position. When the rod assembly is in the curved inward shape, the first rod portion and the second rod portion are mounted relative to the first mount portion and the second mount portion in a third position. In all three positions, the rod assembly lies in a common horizontal plane. As the rod assembly moves between the first position and the second position, the rod assembly lies in the common horizontal plane, along an entire first travel path. As the rod assembly moves between the first position and the third position, the rod assembly lies in the common horizontal plane, along an entire second travel path.

In an exemplary embodiment, the shower rod includes a rod assembly, a first mount/pivot assembly, and a second mount/pivot assembly. The rod assembly includes a first rod portion and a second rod portion. The first rod portion is flexible. The second rod portion is flexible. The second rod portion is operable to slide relative to the first rod portion. The first mount/pivot assembly includes a first mount portion and a first pivot portion. The first mount portion is operable to fixedly mount to a first mounting surface. The first pivot portion is operable to fixedly attach to the first rod portion. The first pivot portion is operable to pivot relative to the first mount portion. The second mount/pivot assembly includes a second mount portion and a second pivot portion. The second mount portion is operable to fixedly mount to an opposed second mounting surface. The second pivot portion is operable to fixedly attach to the second rod portion. The second pivot portion is operable to pivot relative to the second mount portion. The rod assembly is operable to move between a straight shape, a curved outward shape, and a curved inward shape. When the rod assembly is in the straight shape, the first rod portion and the second rod portion are mounted relative to the first mount portion and the second mount portion in a first position. When the rod assembly is in the curved outward shape, the first rod portion and the second rod portion are mounted relative to the first mount portion and the second mount portion in a second position. When the rod assembly is in the curved inward shape, the first rod portion and the second rod portion are mounted relative to the first mount portion and the second mount portion in a third position. As the rod assembly moves between the first position and the second position, the rod assembly pivots about an axis that is perpendicular to the plane in which the rod assembly lies. As the rod assembly moves between the first position and the third position, the rod assembly pivots about an axis that is perpendicular to the plane in which the rod assembly lies.

In an exemplary embodiment, the shower rod includes a rod assembly, a first mount/pivot assembly, and a second mount/pivot assembly. The rod assembly includes a first rod portion and a second rod portion. The first rod portion is flexible. The second rod portion is flexible. The second rod portion is operable to slide relative to the first rod portion. The first mount/pivot assembly includes a first mount portion and a first pivot portion. The first mount portion is operable to fixedly mount to a first mounting surface. The first pivot portion is operable to fixedly attach to the first rod portion. The first pivot portion is operable to pivot relative to the first mount portion. The second mount/pivot assembly includes a second mount portion and a second pivot portion. The second mount portion is operable to fixedly mount to an opposed second mounting surface. The second pivot portion is operable to fixedly attach to the second rod portion. The second pivot portion is operable to pivot relative to the second mount portion. The rod assembly is operable to move between a straight shape, a curved outward shape, and a curved inward shape. When the rod assembly is in the straight shape, the first rod portion and the second rod portion are mounted relative to the first mount portion and the second mount portion in a first position. When the rod assembly is in the curved outward shape, the first rod portion and the second rod portion are mounted relative to the first mount portion and the second mount portion in a second position. When the rod assembly is in the curved inward shape, the first rod portion and the second rod portion are mounted relative to the first mount portion and the second mount portion in a third position. When the rod assembly moves from the first position to the second position, an overall length of the rod assembly increases. When the rod assembly moves from the first position to the third position, the overall length of the rod assembly increase. When the rod assembly is in the second position and the third position, the overall length of the rod assembly is approximately the same.

BRIEF DESCRIPTION OF THE DRAWINGS

—FIG. 1*a* is a top view of the shower rod in a first straight position, FIG. 1*b* is a top view of the shower rod in a second curved outward position, and FIG. 1*c* is a top view of the shower rod in a third curved inward position;

—FIG. 2*a* is a perspective view of the shower rod completely assembled, and FIG. 2*b* is an exploded perspective view of the shower rod partially assembled;

* —FIG. 3*a* is a perspective view of the shower rod completely assembled, and FIG. 3*b* is an exploded perspective view of the shower rod mostly unassembled;

* —FIG. 4*a* is a perspective view of the rod assembly completely assembled, and FIG. 4*b* is an exploded perspective view of the rod assembly completely unassembled;

FIGS. 5*a*-5*f* are views of a cover assembly of the shower rod of FIGS. 2*a*-2*b* —FIG. 5*a* is a perspective view of the cover assembly completely assembled, FIG. 5*b* is an exploded perspective view of the cover assembly partially assembled, FIG. 5*c* is another perspective view of the cover assembly completely assembled, FIG. 5*d* is a side view of the cover assembly completely assembled, FIG. 5*e* is a top view of the cover assembly completely assembled, and FIG. 5*f* is a front view of the cover assembly completed assembled;

* —FIG. 6*a* is a perspective view of the top cover, FIG. 6*b* is a side view of the top cover, FIG. 6*c* is a cross-sectional view of the top cover taken along the line 6*c*-6*c* in FIG. 6*b*, FIG. 6*d* is a cross-sectional view of the top cover taken along the line 6*d*-6*d* in FIG. 6*c*, and FIG. 6*e* is another side view of the top cover;

* —FIG. 7*a* is a perspective view of the bottom cover, FIG. 7*b* is a side view of the bottom cover, FIG. 7*c* is a front view of the bottom cover, and FIG. 7*d* is a top view of the bottom cover;

* —FIG. 8*a* is a perspective view of the snap ring, FIG. 8*b* is a side view of the snap ring, and FIG. 8*c* is a cross-sectional view of the snap ring taken along the line 8*c*-8*c* in FIG. 8*b;*

* —FIG. 9*a* is a perspective view of the mount/pivot assembly completely assembled, and FIG. 9*b* is an exploded perspective view of the mount/pivot assembly completely unassembled;

* —FIG. 10*a* is a perspective view of the wall bracket, FIG. 10*b* is a top view of the wall bracket, FIG. 10*c* is a side view of the wall bracket, and FIG. 10*d* is a cross-sectional view of the wall bracket taken along the line 10*d*-10*d* in FIG. 10*c;*

* —FIG. 11*a* is a perspective view of the pivot flange, FIG. 11*b* is another perspective view of the pivot flange, FIG. 11*c* is a front view of the pivot flange, Figure 11*d* is a top view of the pivot flange, and FIG. 11*e* is a side view of the pivot flange;

* —FIG. 12*a* is a perspective view of the pivot arm, FIG. 12*b* is a top view of the pivot arm, FIG. 12*c* is a cross-sectional view of the pivot arm taken along the line 12*c*-12*c* in FIG. 12*b*, FIG. 12*d* is a side view of the pivot arm, and FIG. 12*e* is a front view of the pivot arm; * —FIG. 13*a* is a partial cross-sectional front view of the shower rod completely assembled in a straight position, FIG. 13*b* is a partial cross-sectional top view of the shower rod completely assembled in a straight position, and FIG. 13*c* is a partial cross-sectional top view of the shower rod completely assembled in a curved position;

where the description of the views is specified relative to the shower rod in an installed position.

DETAILED DESCRIPTION

Figures 1A, 1B, 1C:
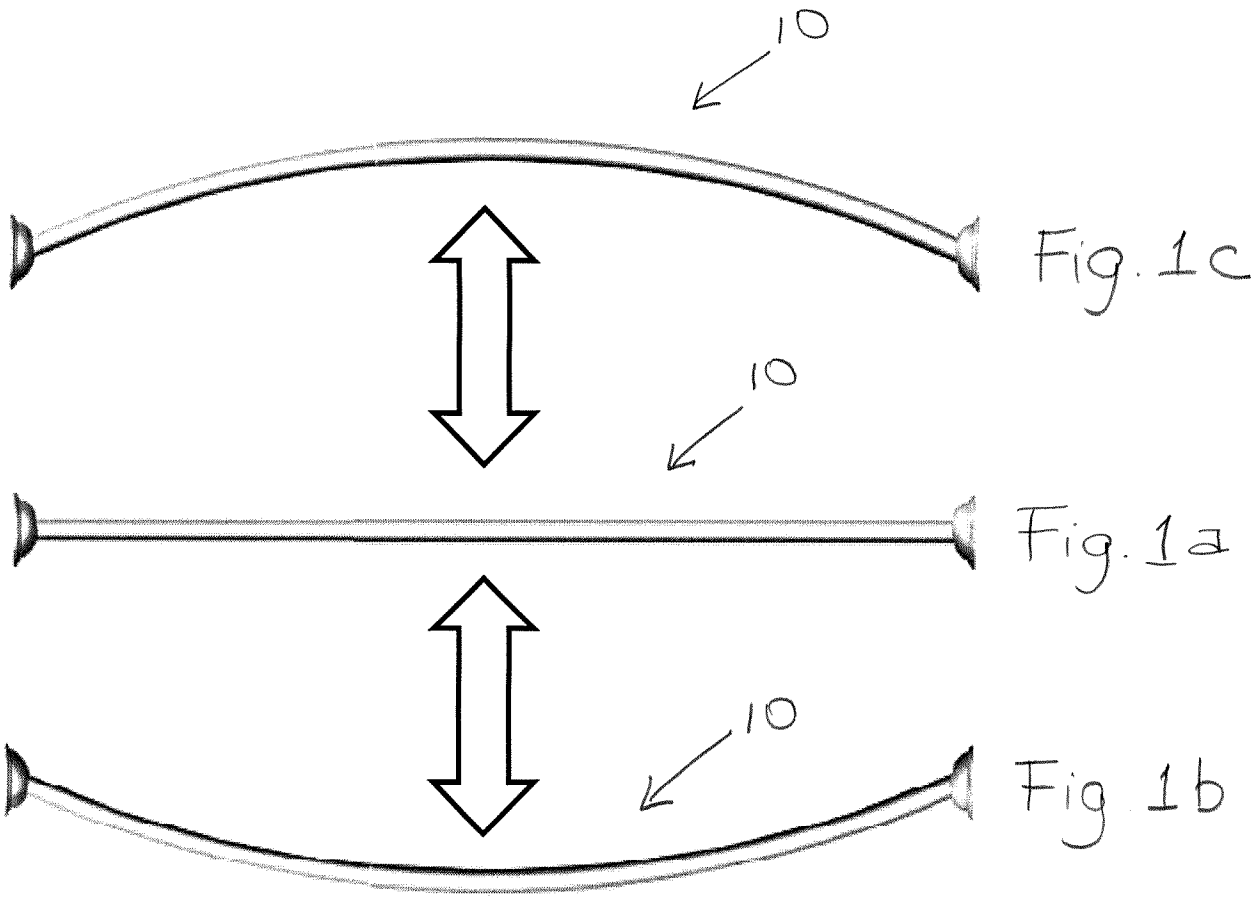
FIGS. 1*a*-1*c* are views of a shower rod according to an exemplary embodiment of the present invention

The present invention provides a shower rod. As best shown in FIGS. 1*a*-1*c*, the shower rod enables a user to move the shower rod between multiple positions in which: (1) it is curved and extends outside a shower enclosure, providing more room in the shower, (2) it is straight and extends along an edge of the shower enclosure, providing a traditional look to the shower rod, and (3) it is curved and extends inside the shower enclosure, providing more room in the bathroom and enabling objects to be hung on the shower rod.

Figure 2B:
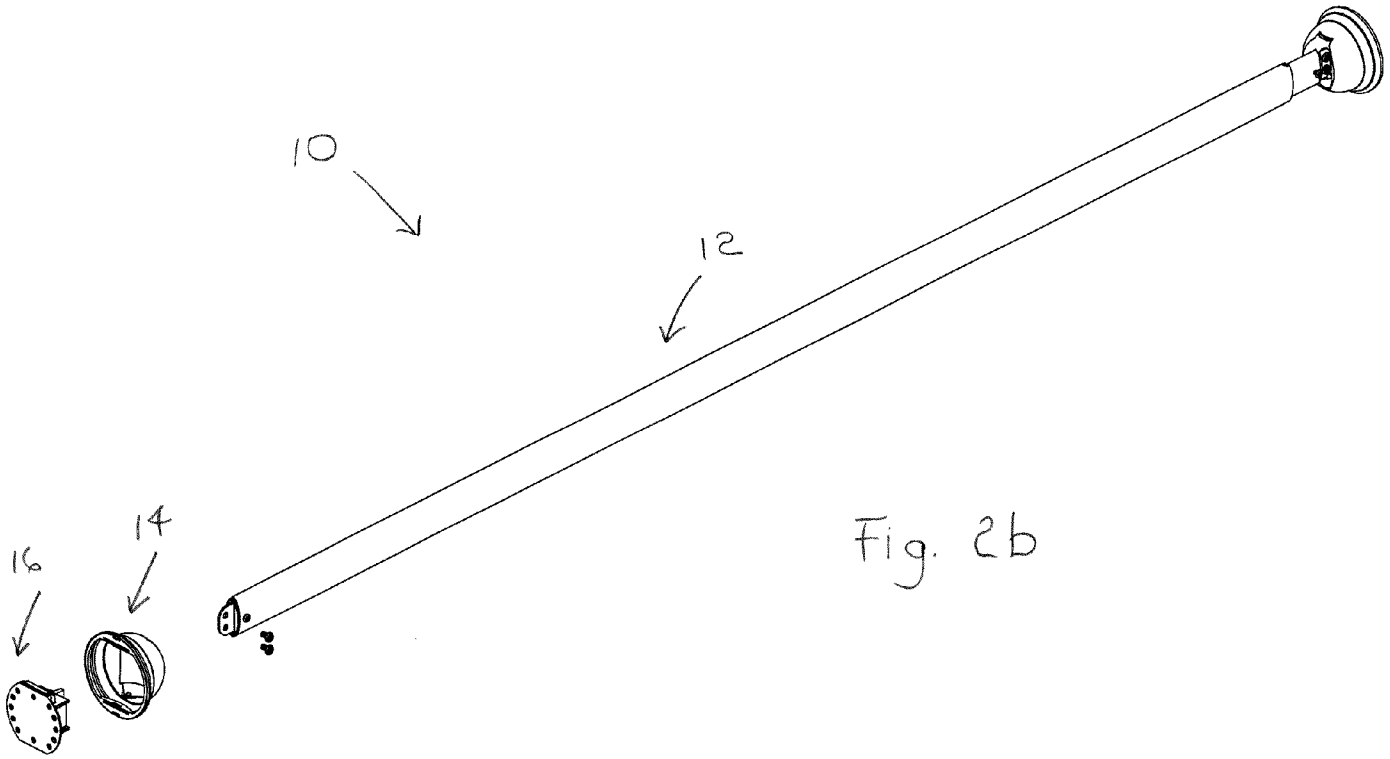
FIGS. 2*a*-2*b* are views of a shower rod according to an exemplary embodiment of the present invention
Figure 2A:
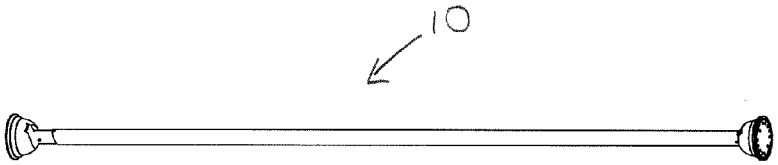
Figures 3A, 3B:
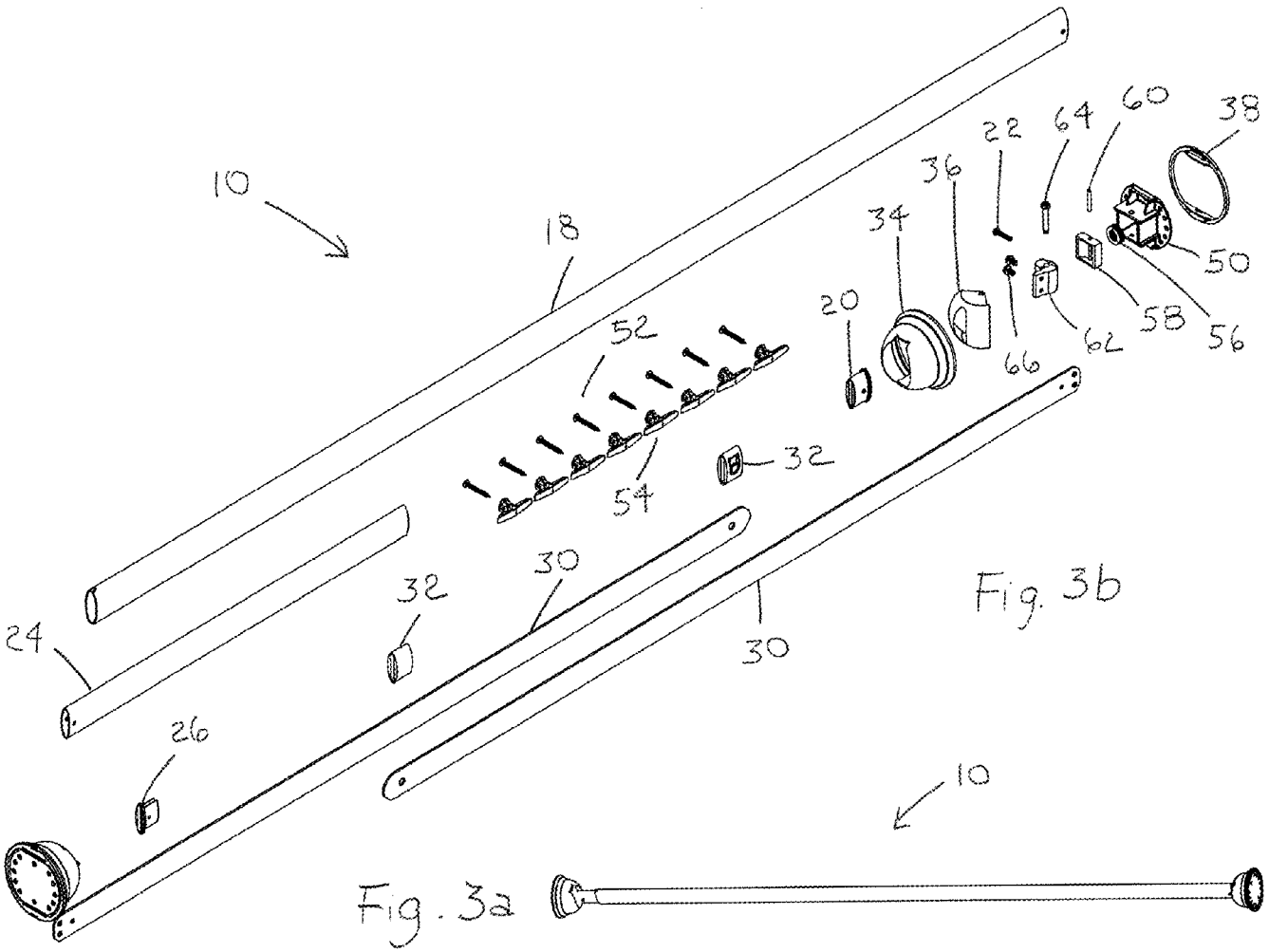
FIGS. 3*a*-3*b* are views of the shower rod of FIGS. 2*a*-2*b
Figure 4A:
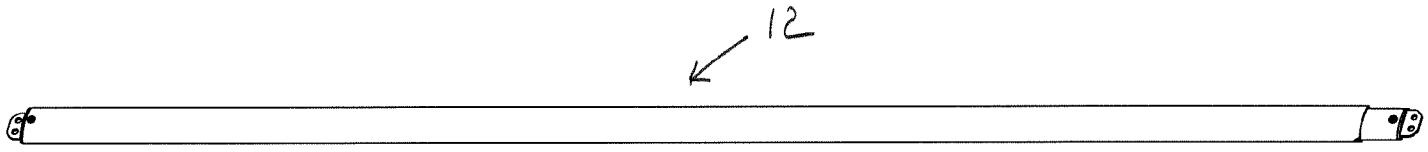
FIGS. 4*a*-4*b* are views of a rod assembly of the shower rod of FIGS. 2*a*-2*b
Figure 4B:
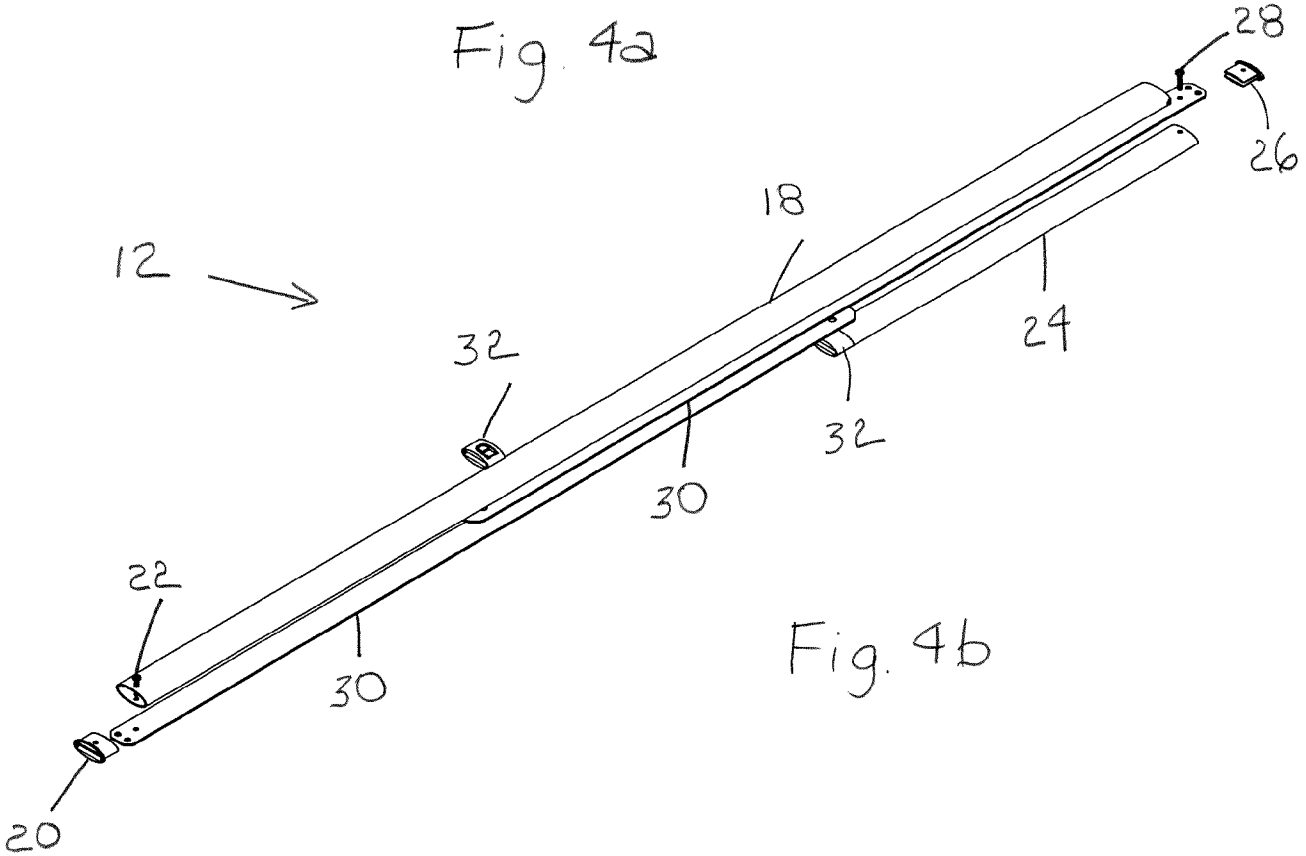
Figure 5A:
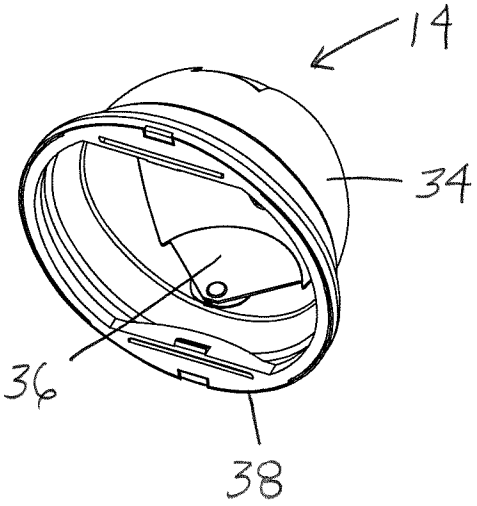
Figure 5B:
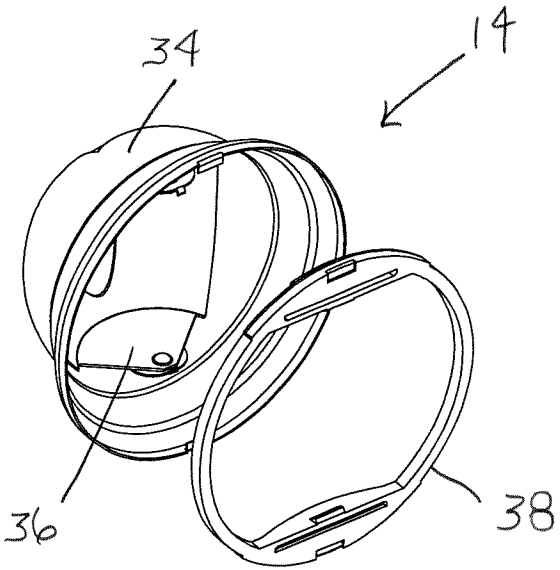
Figure 5C:
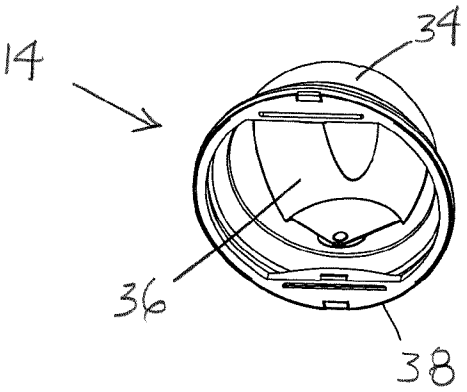
Figure 5F:
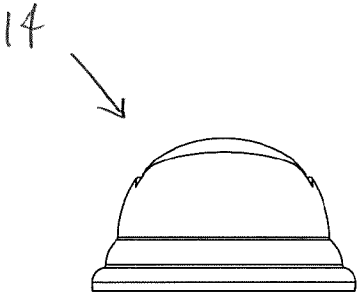
Figure 5D:
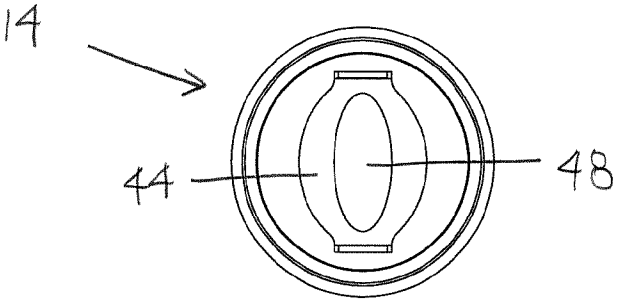
Figure 5A:
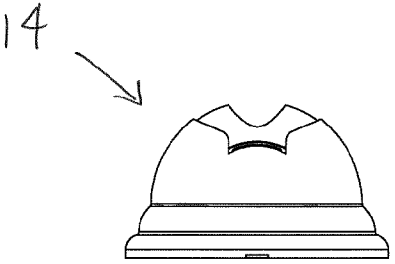
Figure 6A:
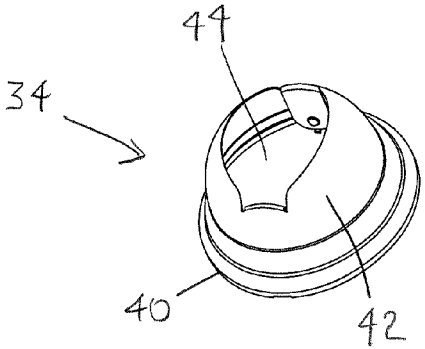
FIGS. 6*a*-6*e* are views of a top cover of the cover assembly of FIGS. 5*a*-5*b
Figure 6D:
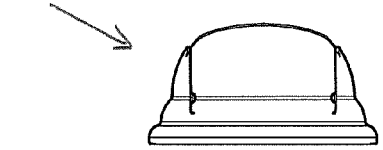
Figure 6B:
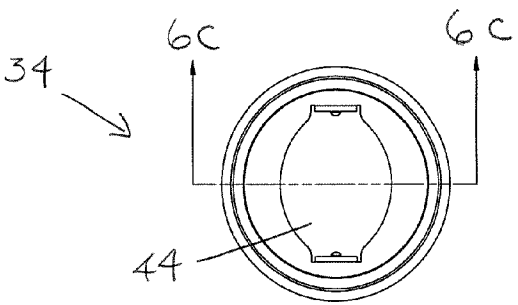
Figure 6C:
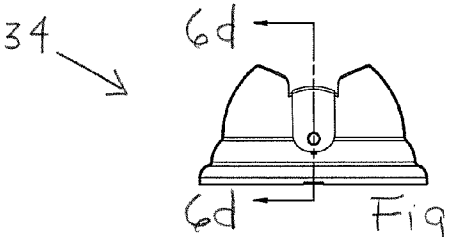
Figure 6E:
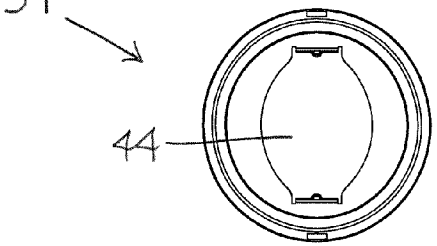
Figure 7A:
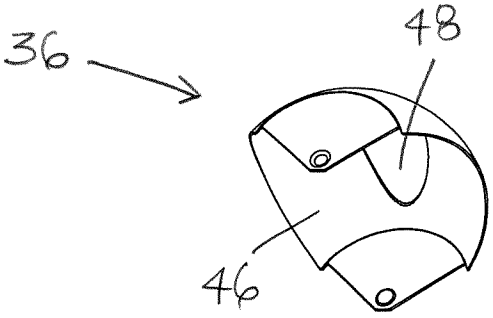
FIGS. 7*a*-7*d* are views of a bottom cover of the cover assembly of FIGS. 5*a*-5*b
Figure 7B:
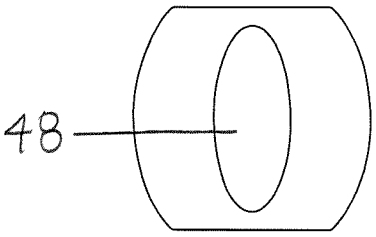
Figure 7C:
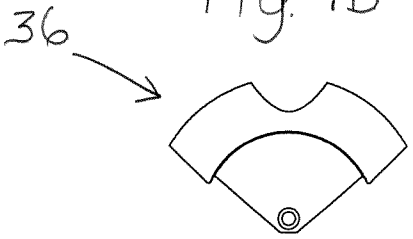
Figure 7D:
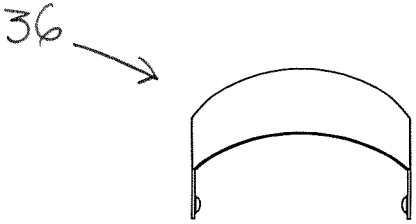
Figure 8A:
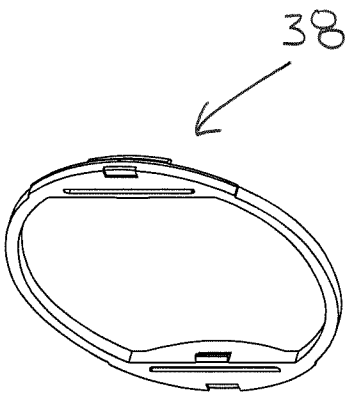
FIGS. 8*a*-8*c* are views of a snap ring of the cover assembly of FIGS. 5*a*-5*b
Figure 8C:
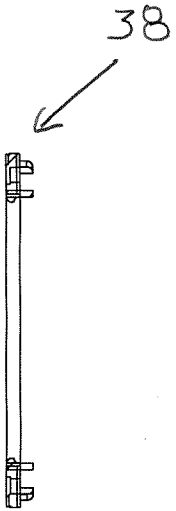
Figure 8B:
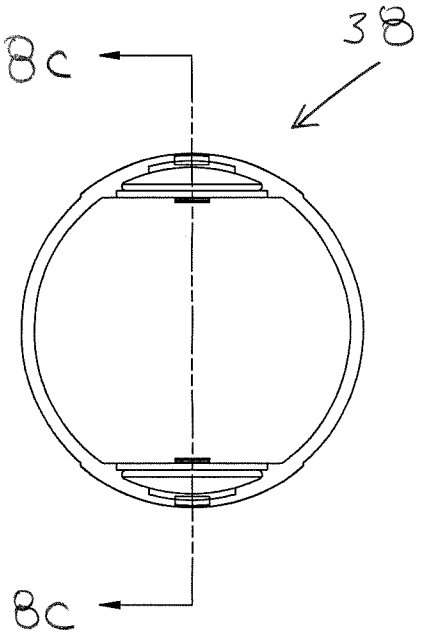
Figure 9A:
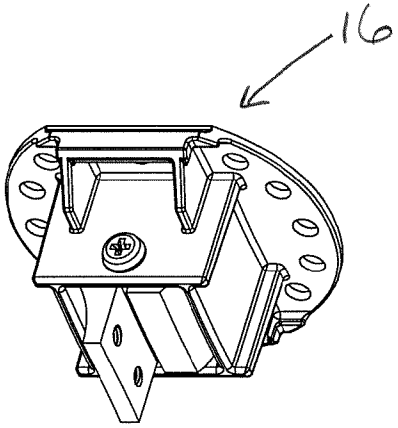
FIGS. 9*a*-9*b* are views of a mount/pivot assembly of the shower rod of FIGS. 2*a*-2*b
Figure 9B:
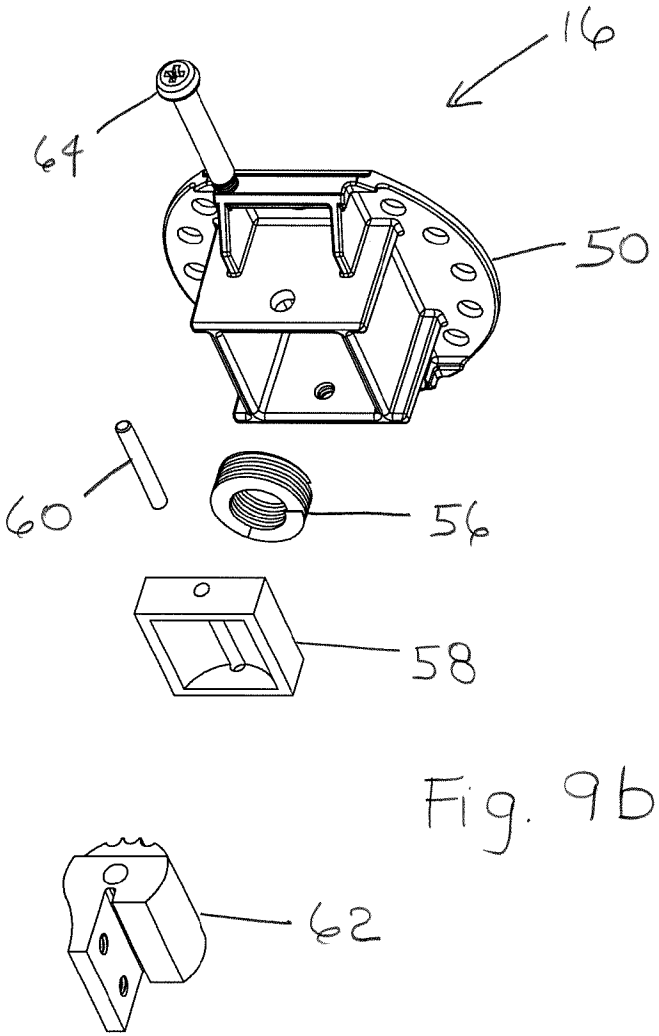
Figure 10A:
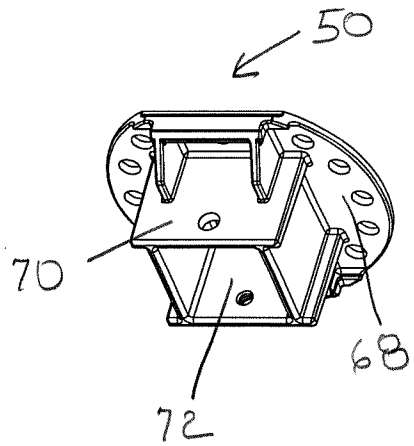
FIGS. 10*a*-10*d* are views of a wall bracket of the mount/pivot assembly of FIGS. 9*a*-9*b
Figure 10B:
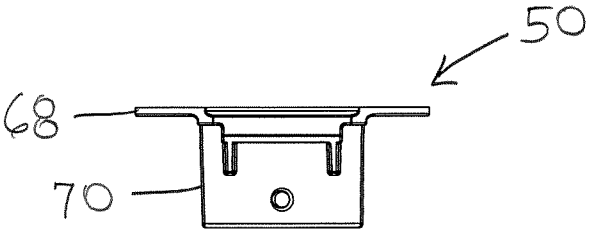
Figure 10C:
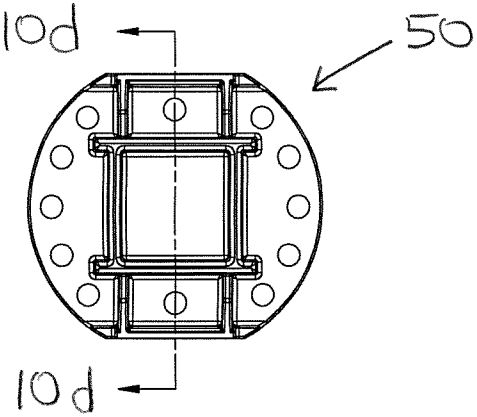
Figure 10D:
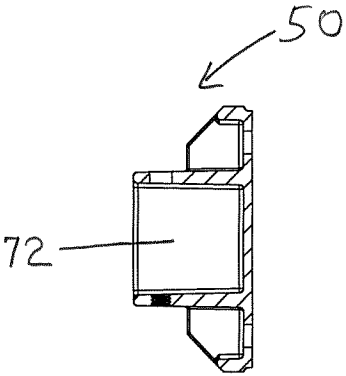
Figure 11A:
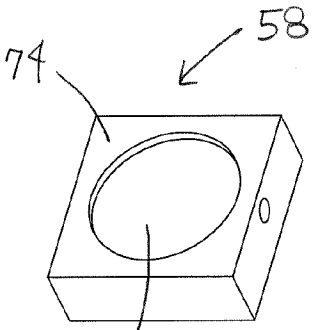
FIGS. 11*a*-11*e* are views of a pivot flange of the mount/pivot assembly of FIGS. 9*a*-9*b
Figure 11B:
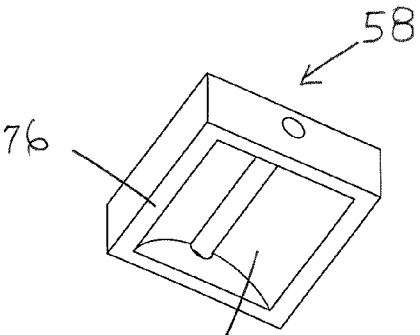
Figure 11D:
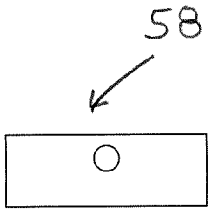
Figure 11C:
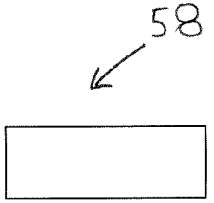
Figure 11E:
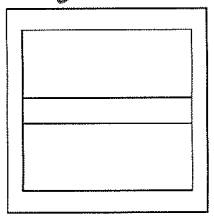
Figure 12A:
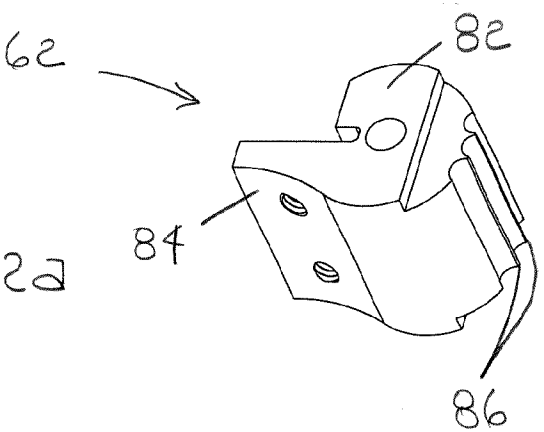
FIGS. 12*a*-12*e* are views of a pivot arm of the mount/pivot assembly of FIGS. 9*a*-9*b
Figure 12E:
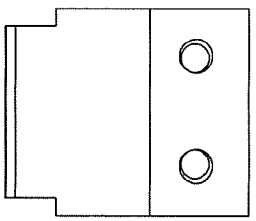
Figure 12D:
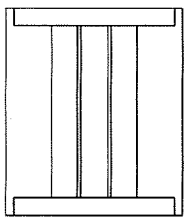
Figure 12B:
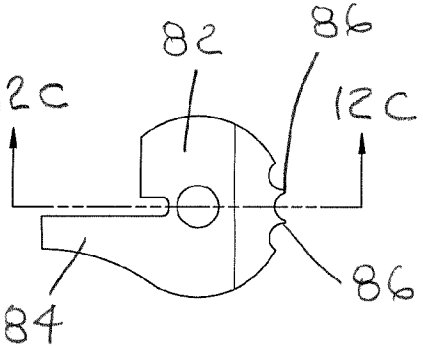
Figure 12C:
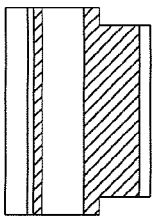

An exemplary embodiment of a shower rod 10 of the present invention is shown in detail in FIGS. 2*a*-13*c*. In an exemplary embodiment, as best shown in FIGS. 2*a*-2*b*, the shower rod 10 includes a rod assembly 12, two cover assemblies 14, and two mount/pivot assemblies 16.

An exemplary embodiment of the rod assembly 12 is shown in detail in FIGS. 3*a*-3*b* and 4*a*-4*b*. In an exemplary embodiment, the rod assembly 12 includes an outer tube 18, an outer tube bushing 20, an outer tube bushing screw 22, an inner tube 24, an inner tube bushing 26, an inner tube bushing screw 28, two insert bars 30, and two insert bar retainers 32.

Each of the outer tube 18, the inner tube 24, and the insert bars 30 has an outer end and an inner end. As used herein, the outer end of the inner tube 18, the outer tube 24, and the insert bars 30 is an end that attaches to or interfaces with the mount/pivot assembly 16. Conversely, the inner end of the inner tube 18, the outer tube 24, and the insert bars 30 is an end that does not attach to or interface with the mount/pivot assembly 16.

In an exemplary embodiment, the outer tube 18 is hollow and flexible. In the illustrated embodiment, the outer tube 18 has a generally oval cross-sectional shape. In an exemplary embodiment, the outer tube bushing 20 is operable to be received in the outer end of the outer tube 18 and to receive the outer end of one insert bar 30. In an exemplary embodiment, the outer tube bushing screw 22 is operable to secure the outer tube bushing 20 to the outer end of the outer tube 18 and the outer end of the one insert bar 30.

In an exemplary embodiment, the inner tube 24 is hollow and flexible. In the illustrated embodiment, the inner tube 24 has a generally oval cross-sectional shape. The inner tube 24 is operable to telescopically slide within the outer tube 18. In an exemplary embodiment, the inner tube bushing 26 is operable to be received in the outer end of the inner tube 24 and to receive the outer end of the other insert bar 30. In an exemplary embodiment, the inner tube bushing screw 28 is operable to secure the inner tube bushing 26 to the outer end of the inner tube 24 and the outer end of the other insert bar 30.

In an exemplary embodiment, each insert bar 30 is solid and flexible. In the illustrated embodiment, each insert bar 30 has a generally rectangular cross-sectional shape. The insert bars 30 are operable to slide relative to each other. The insert bars 30 are operable to slide within the outer tube 18 and the inner tube 24. In an exemplary embodiment, each insert bar retainer 32 is operable to be slid onto and secured to the inner end of one insert bar 30, to be slidably received within an interior of the outer tube 18 or the inner tube 24, and to slidably receive the other insert bar 30.

Although the shower rod 10 has been shown and described as including the outer tube 18, the inner tube 24, and two insert bars 30, one of ordinary skill in the art will appreciate that the shower rod 10 could include: (1) an outer tube and an inner tube with no insert bars, or (2) bars with no outer tube and no inner tube.

In an exemplary embodiment, the rod assembly 12 includes a first rod portion and a second rod portion. The second rod portion is operable to slide relative to the first rod portion. In an exemplary embodiment, the first rod portion includes the outer tube 18 and one insert bar 30, and the second rod portion includes the inner tube 24 and another insert bar 30. In an exemplary embodiment, the first rod portion includes the outer tube 18, and the second rod portion includes the inner tube 24. In an exemplary embodiment, the first rod portion includes one bar 30, and the second rod portion includes another bar 30.

An exemplary embodiment of the cover assembly 14 is shown in detail in FIGS. 3*a*-3*b* and 5*a*-8*c*. In an exemplary embodiment, each cover assembly 14 (best shown in FIGS. 5*a*-5*f*) includes a top cover 34 (best shown in FIGS. 6*a*-6*e*), a bottom cover 36 (best shown in FIGS. 7*a*-7*d*), and a snap ring 38 (best shown in FIGS. 8*a*-8*c*).

In an exemplary embodiment, the top cover 34 includes a cover base 40 and a dome 42. In an exemplary embodiment, the dome 42 of the top cover 34 includes an opening 44 therein. In an exemplary embodiment, the bottom cover 36 includes a partial dome 46. In an exemplary embodiment, the partial dome 46 of the bottom cover 36 includes an opening 48 therein. The partial dome 46 of the bottom cover 36 is operable to be secured to the dome 42 of the top cover 34. The partial dome 46 of the bottom cover 36 is operable to pivot within the dome 42 of the top cover 34. The opening 48 in the partial dome 46 of the bottom cover 36 generally underlies the opening 44 in the dome 42 of the top cover 34. In an exemplary embodiment, the snap ring 38 is operable to be received and secured in the cover base 40 of the top cover 34. In an exemplary embodiment, the snap ring 38 is integrally formed with the cover base 40 of the top cover 34.

In an exemplary embodiment, the cover assembly includes a fixed cover and a pivot cover. In an exemplary embodiment, the fixed cover is operable to be fixedly mounted relative to a mounting surface. In an exemplary embodiment, the pivot cover is operable to be pivotally mounted relative to the mounting surface. In an exemplary embodiment, the fixed cover includes the top cover 34. In an exemplary embodiment, the pivot cover includes the bottom cover 36.

An exemplary embodiment of the mount/pivot assembly 16 is shown in detail in FIGS. 3*a*-3*b* and 9*a*-12*e*. In an exemplary embodiment, each mount/pivot assembly 16 (best shown in FIGS. 9*a*-9*b*) includes a wall bracket 50 (best shown in FIGS. 10*a*-10*d*), wall bracket screws 52, wall bracket fasteners 54, a spring 56, a pivot flange 58 (best shown in FIGS. 11*a*-11*e*), a pivot flange pin 60, a pivot arm 62 (best shown in FIGS. 12*a*-12*e*), a pivot arm pin 64, and pivot arm screws 66.

In an exemplary embodiment, the wall bracket 50 includes a bracket plate 68 and a bracket base 70. The bracket base 70 forms a bracket cavity 72. The bracket plate 68 is operable to be attached to the mounting surface via the wall bracket screws 52 and the wall bracket fasteners 54. The bracket cavity 72 is operable to receive the spring 56, the pivot flange 58, the pivot flange pin 60, the pivot arm 62, and the pivot arm pin 64.

In an exemplary embodiment, the pivot flange 58 includes a first side 74 and a second side 76. The first side 74 of the pivot flange 58 includes a depression 78 operable to receive one end of the spring 56. The second side 76 of the pivot flange 58 includes a socket 80 operable to receive a portion of the pivot arm 62 and the pivot flange pin 60.

In an exemplary embodiment, the pivot arm 62 includes a pivot portion 82 and an attachment portion 84. The pivot portion 82 of the pivot arm 62 includes a plurality of teeth 86 operable to engage the pivot flange pin 60. The pivot portion 82 of the pivot arm 62 is secured in the bracket cavity 72 via the pivot arm pin 64. The attachment portion 84 of the pivot arm 62 is operable to be attached to the outer end of the insert bar 30 via the pivot arm screws 66. The pivot arm 62 is operable to pivot relative to the pivot flange 58 and the wall bracket 50.

In an exemplary embodiment, the mount/pivot assembly includes a mount portion and a pivot portion. In an exemplary embodiment, the mount portion is operable to fixedly mount to the mounting surface. In an exemplary embodiment, the pivot portion is operable to fixedly attach to the rod assembly 12. In an exemplary embodiment, the pivot portion is operable to pivot relative to the mount portion. In an exemplary embodiment, the mount portion includes the wall bracket 50. In an exemplary embodiment, the pivot portion includes the pivot arm 62.

In an exemplary embodiment, the shower rod 10 is preassembled. Exemplary assembly steps will be described. The assembly of the shower rod 10 includes the assembly of the cover assemblies 14, the assembly of the rod assembly 12, and the assembly of the mount/pivot assemblies 16.

In an exemplary embodiment, two cover assemblies 14 are preassembled. Exemplary assembly steps will be described. The bottom cover 36 is inserted into and secured in the dome 42 of the top cover 34 via a snap fit. The snap ring 38 is inserted into and secured in the cover base 40 of the top cover 34 via a snap fit.

In an exemplary embodiment, the rod assembly 12 is preassembled. Exemplary assembly steps will be described. One insert bar retainer 32 is slid onto and secured to the inner end of each insert bar 30 via a snap fit. The outer end of each insert bar 30 is slid into the insert bar retainer 32 secured to the inner end of the other insert bar 30. As a result, each insert bar 30 is secured to one insert bar retainer 32 and can slide in the other insert bar retainer 32. The inner tube 24 is slid onto the outer end of one insert bar 30. The outer tube 18 is slid onto the outer end of the other insert bar 30. The outer tube 18 is slid over a portion of the inner tube 24. One preassembled cover assembly 14 is slid onto the outer end of the inner tube 24. The other preassembled cover assembly 14 is slid onto the outer end of the outer tube 18. The inner tube bushing 26 is inserted into the outer end of the inner tube 24 with the outer end of one insert bar 30 extending through the inner tube bushing 26. The outer tube bushing 20 is inserted into the outer end of the outer tube 18 with the outer end of the other insert bar 30 extending through the outer tube bushing 20. The inner tube bushing screw 28 is inserted through openings in the outer end of the inner tube 24, the inner tube bushing 26, and the outer end of one insert bar 30. The outer tube bushing screw 22 is inserted through openings in the outer end of the inner tube 24, the inner tube bushing 26, and the outer end of the other insert bar 30.

In an exemplary embodiment, two mount/pivot assemblies 16 are preassembled. Exemplary assembly steps for will be described. One end of the spring 56 is inserted into the bracket cavity 72 in the wall bracket 50. The pivot flange pin 60 is inserted through openings in the pivot flange 58. The pivot flange 58 (with the pivot flange pin 60) is inserted into the bracket cavity 72 in the wall bracket 50 such that the other end of the spring 56 is received in the depression 78 in the first side 74 of the pivot flange 58. The pivot arm 62 is inserted into the bracket cavity 72 such that the teeth 86 on the pivot portion 82 of the pivot arm 62 engage the pivot flange pin 60 in the pivot flange 58. The pivot arm pin 64 is inserted through openings in the bracket base 70 of the wall bracket 50 and the pivot portion 82 of the pivot arm 62. The attachment portion 84 of one pivot arm 62 is inserted into the inner tube bushing 26. The attachment portion 84 of the other pivot arm 62 is inserted into the outer tube bushing 20. The pivot arm screws 66 are inserted through openings in the attachment portion 84 of one pivot arm 62 and the outer end of one insert bar 30. The pivot arm screws 66 are inserted through openings in the attachment portion 84 of the other pivot arm 62 and the outer end of the other insert bar 30.

The shower rod 10 is now preassembled with the cover assemblies 14 slidably received on the rod assembly 12 and the mount/pivot assemblies 16 attached to the rod assembly 12.

In an exemplary embodiment, the shower rod 10 is installed between two opposed mounting surfaces. Exemplary installation steps will be described. Holes are drilled in the two mounting surfaces at the location where each end of the shower rod 10 is to be installed. One wall bracket 50 is placed against one mounting surface and secured thereto via openings in the bracket plate 68 of the wall bracket 50, the wall bracket screws 52, and the wall bracket fasteners 54. The other wall bracket 50 is placed against the other mounting surface and secured thereto via openings in the bracket plate 68 of the wall bracket 50, the wall bracket screws 52, and the wall bracket fasteners 54. One cover assembly 14 is slid outwardly over one mount/pivot assembly 16 and secured thereto via a snap fit between the snap ring 38 and the wall bracket 50. The other cover assembly 14 is slid outwardly over the other mount/pivot assembly 16 and secured thereto via a snap fit between the snap ring 38 and the wall bracket 50.

The shower rod 10 is now installed with the mount/pivot assemblies 16 and the cover assemblies 14 attached to the opposed mounting surfaces with the rod assembly 12 extending between the mount/pivot assemblies 16 and the cover assemblies 14. In this position, the shower rod 10 is straight.

Figure 13A:
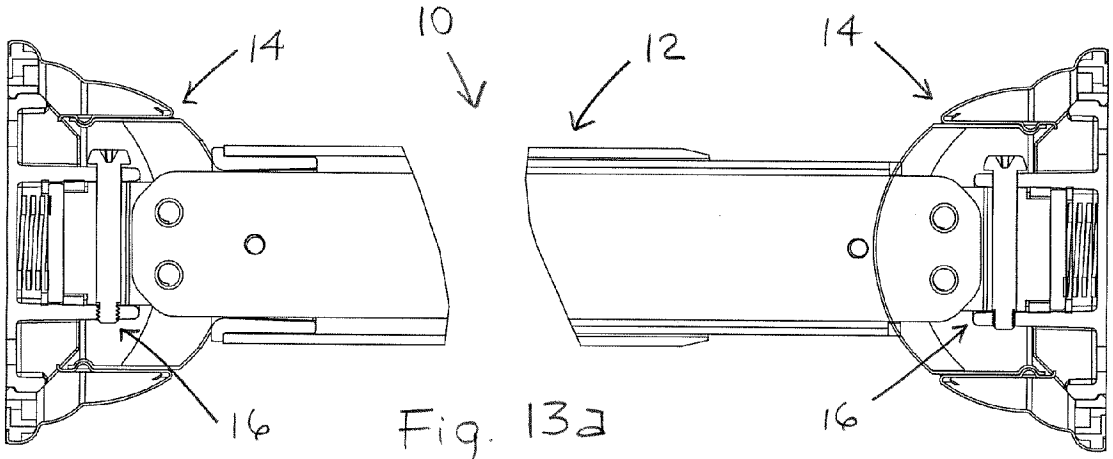
FIGS. 13*a*-13*c* are views of the shower rod of FIGS. 2*a*-2*b
Figure 13B:
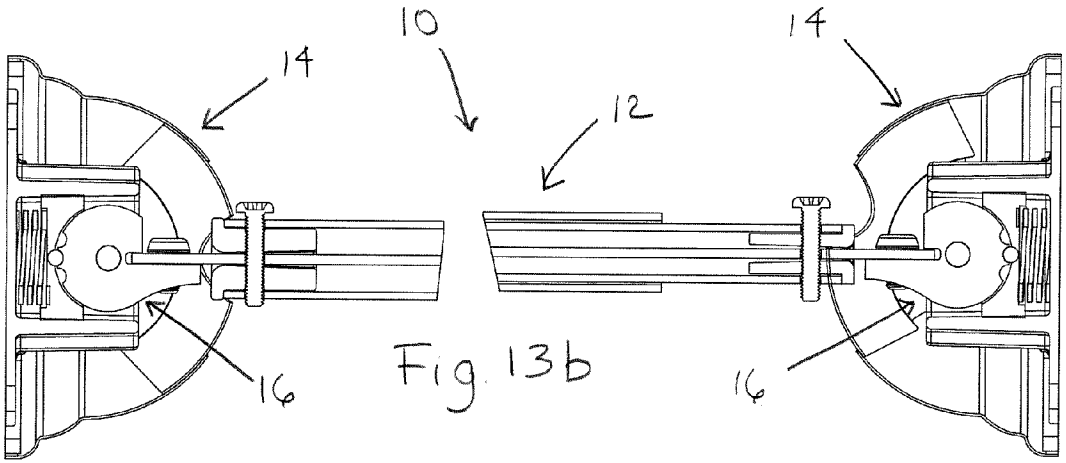
Figure 13C:
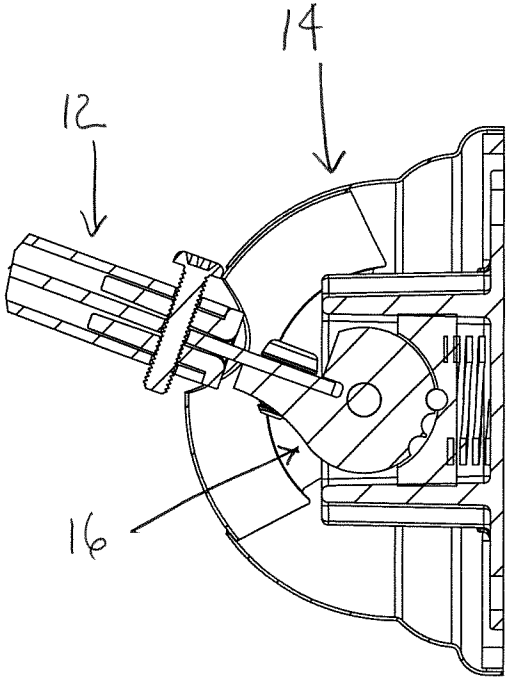

During use, the shower rod 10 can be extended outside or inside the shower enclosure. The design of the rod assembly 12 enables the inner tube 24, the outer tube 18, and the insert bars 30 to bend and extend when an outward or inward lateral force is applied to them. As the inner tube 24, the outer tube 18, and the insert bars 30 bend and extend, the inner tube 24 slides further out of the outer tube 18 and the insert bars 30 slide further apart in a longitudinal direction. The design of the mount/pivot assemblies 16 enables the inner tube 24, the outer tube 18, and the insert bars 30 to be maintained in an outward or inward curved position once they have been bent and extended. More specifically, as best shown in FIGS. 13*a*-13*c*, the engagement of the teeth 86 on the pivot portion 82 of the pivot arm 62 with the pivot flange pin 60 in the pivot flange 58, and the engagement of the pivot flange 58 with the spring 56, enables the inner tube 24, the outer tube 18, and the insert bars 30 to be maintained in the outward or inward curved position once they have been bent and extended.

In an exemplary embodiment, the rod assembly 12 is operable to move between a straight shape, a curved outward shape, and a curved inward shape. In an exemplary embodiment, the rod assembly 12 is operable to pivot between a straight shape, a curved outward shape, and a curved inward shape. When the rod assembly 12 is in the straight shape, the rod assembly 12 is mounted relative to the mount/pivot assemblies 16 in a first position. When the rod assembly 12 is in the curved outward shape, the rod assembly 12 is mounted relative to the mount/pivot assemblies 16 in a second position. When the rod assembly 12 is in the curved inward shape, the rod assembly 12 is mounted relative to the mount/pivot assemblies 16 in a third position.

In an exemplary embodiment, in all three positions, the rod assembly 12 lies in a common horizontal plane. As used herein, the horizontal plane of the rod assembly 12 is a horizontal plane through a center line of the rod assembly 12. More specifically, the center line of the rod assembly 12 is a center line through the outer tube 18 and the inner tube 24 (in an exemplary embodiment including the outer tube 18 and the inner tube 24) or a center line through the bars 30 (in an exemplary embodiment not including the outer tube 18 and the inner tube 24).

In an exemplary embodiment, as the rod assembly 12 moves between the first position and the second position, the rod assembly 12 lies in the common horizontal plane, along an entire first travel path of the rod assembly 12. In an exemplary embodiment, as the rod assembly 12 pivots between the first position and the second position, the rod assembly 12 lies in the common horizontal plane, along the entire first travel path of the rod assembly 12. In an exemplary embodiment, as the rod assembly 12 moves between the first position and the third position, the rod assembly 12 lies in the common horizontal plane, along an entire second travel path of the rod assembly 12. In an exemplary embodiment, as the rod assembly 12 pivots between the first position and the third position, the rod assembly 12 lies in the common horizontal plane, along the entire second travel path of the rod assembly 12.

In an exemplary embodiment, as the rod assembly 12 moves between the first position and the second position, the rod assembly 12 pivots about an axis that is perpendicular to the plane in which the rod assembly 12 lies. In an exemplary embodiment, as the rod assembly 12 moves between the first position and the third position, the rod assembly 12 pivots about an axis that is perpendicular to the plane in which the rod assembly 12 lies. As used herein, the pivot axis of the rod assembly 12 is a pivot axis of either mount/pivot assembly 16.

In an exemplary embodiment, as the rod assembly 12 moves between the first position and the second position, the rod assembly 12 pivots about a first vertical axis and a second vertical axis while the rod assembly 12 lies in the common horizontal plane. In an exemplary embodiment, as the rod assembly 12 moves between the first position and the third position, the rod assembly 12 pivots about the first vertical axis and the second vertical axis while the rod assembly 12 lies in the common horizontal plane. As used herein, the first pivot axis is a pivot axis of one mount/pivot assembly 16, and the first rod portion of the rod assembly 12 pivots about the first pivot axis. As used herein, the second pivot axis is a pivot axis of the other mount/pivot assembly 16, and the second rod portion of the rod assembly 12 pivots about the second pivot axis.

In an exemplary embodiment, when the rod assembly 12 moves from the first position to the second position, an overall length of the rod assembly 12 increases. In an exemplary embodiment, when the rod assembly 12 moves from the second position to the first position, the overall length of the rod assembly 12 decreases. In an exemplary embodiment, when the rod assembly 12 moves from the first position to the third position, the overall length of the rod assembly 12 increases. In an exemplary embodiment, when the rod assembly 12 moves from the third position to the first position, the overall length of the rod assembly 12 decreases. In an exemplary embodiment, when the rod assembly 12 is in the second position and the third position, the overall length of the rod assembly 12 is approximately the same.

In an exemplary embodiment, when the rod assembly 12 moves from the first position to the second position, an overall shape of the rod assembly 12 changes (i.e., from straight to curved). In an exemplary embodiment, when the rod assembly 12 moves from the second position to the first position, the overall shape of the rod assembly 12 changes (i.e., from curved to straight). In an exemplary embodiment, when the rod assembly 12 moves from the first position to the third position, the overall shape of the rod assembly 12 changes (i.e., from straight to curved). In an exemplary embodiment, when the rod assembly 12 moves from the third position to the first position, the overall shape of the rod assembly 12 changes (i.e., from curved to straight). In an exemplary embodiment, when the rod assembly 12 is in the second position and the third position, the overall shape of the rod assembly 12 is approximately the same (i.e., curved).

In an exemplary embodiment, the wall bracket 50 is operable to be fixedly mounted relative to the mounting surface, the top cover 34 is operable to be fixedly mounted relative to the mounting surface, and the bottom cover 36 is operable to be pivotally mounted relative to the mounting surface. In an exemplary embodiment, the wall bracket 50 is operable to be fixedly attached to the mounting surface, the top cover 34 is operable to be fixedly connected to the wall bracket 50, and the bottom cover 36 is operable to be pivotally connected to the top cover 34.

Since the top cover 34 is fixedly connected and will not move with the outer tube 18 and the inner tube 24, the opening 44 in the top cover 34 must be large enough to accommodate the movement of the shower rod 10 from a position extending outside the shower enclosure through a position extending inside the shower enclosure. Since the bottom cover 36 is pivotally connected and will move with the outer tube 18 and the inner tube 24, the opening 48 in the bottom cover 36 only needs to be large enough to accommodate the shower rod 10 in a single position (thus, it can be smaller which is aesthetically more desirable).

Although the shower rod 10 has been shown and described as including a fixedly mounted top cover 34 and a pivotally mounted bottom cover 36, one of ordinary skill in the art will appreciate that the shower rod 10 could include a pivotally mounted top cover and a fixedly mounted bottom cover.

In an exemplary embodiment, the outer tube 18 and the inner tube 24, with the insert bars 30 received therein, are operable to move between a straight shape, a curved outward shape, and a curved inward shape. When the outer tube 18 and the inner tube 24 are in the straight shape, the bottom cover 36 is centered relative to the top cover 34. As the outer tube 18 and the inner tube 24 move from the straight shape to the curved outward shape, the bottom cover 36 pivots outwardly relative to the top cover 34. As the outer tube 18 and the inner tube 24 move from the straight shape to the curved inward shape, the bottom cover 36 pivots inwardly relative to the top cover 34.

While the shower rod 10 has been shown and described in the illustrated embodiment as including certain components, one of ordinary skill in the art will appreciate that the shower rod 10 does not need to include each of these components.

While the shower rod 10 has been shown and described in the illustrated embodiment with the components attached in a particular manner, one of ordinary skill in the art will appreciate that the components of the shower rod 10 do not need to be attached in this particular manner.

One of ordinary skill in the art will now appreciate that the present invention provides a shower rod that can be moved between a straight position and curved positions. Although the present invention has been shown and described with reference to particular embodiments, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A shower rod, comprising:

a rod assembly, including:

a first rod portion, the first rod portion being flexible; and a second rod portion, the second rod portion being flexible, the second rod portion being operable to slide relative to the first rod portion;

a first mount/pivot assembly, including:

a first mount portion, the first mount portion being operable to fixedly mount to a first mounting surface; and a first pivot portion, the first pivot portion being operable to fixedly attach to the first rod portion, the first pivot portion being operable to pivot relative to the first mount portion; and a second mount/pivot assembly, including:

a second mount portion, the second mount portion being operable to fixedly mount to an opposed second mounting surface; and a second pivot portion, the second pivot portion being operable to fixedly attach to the second rod portion, the second pivot portion being operable to pivot relative to the second mount portion;

wherein the rod assembly is operable to move between a straight shape, a curved outward shape, and a curved inward shape;

wherein, when the rod assembly is in the straight shape, the first rod portion and the second rod portion are mounted relative to the first mount portion and the second mount portion in a first position;

wherein, when the rod assembly is in the curved outward shape, the first rod portion and the second rod portion are mounted relative to the first mount portion and the second mount portion in a second position;

wherein, when the rod assembly is in the curved inward shape, the first rod portion and the second rod portion are mounted relative to the first mount portion and the second mount portion in a third position;

wherein, in all three positions, the rod assembly lies in a common horizontal plane;

wherein, as the rod assembly moves between the first position and the second position, the rod assembly lies in the common horizontal plane, along an entire first travel path; and wherein, as the rod assembly moves between the first position and the third position, the rod assembly lies in the common horizontal plane, along an entire second travel path.

2. The shower rod of claim 1, wherein:

the first rod portion includes an outer tube; and the second rod portion includes an inner tube.

3. The shower rod of claim 2, wherein:

the outer tube is hollow; and the inner tube is hollow.

4. The shower rod of claim 1, wherein:

the first rod portion includes a first insert bar; and the second rod portion includes a second insert bar.

5. The shower rod of claim 4, wherein:

the first insert bar is solid; and the second insert bar is solid.

6. The shower rod of claim 1, wherein:

the first rod portion includes a first bar; and the second rod portion includes a second bar.

7. The shower rod of claim 6, wherein:

the first bar is solid; and the second bar is solid.

8. The shower rod of claim 1, wherein:

the first mount portion includes a first wall bracket; and the second mount portion includes a second wall bracket.

9. The shower rod of claim 1, wherein:

the first pivot portion includes a first pivot arm; and the second pivot portion includes a second pivot arm.

10. The shower rod of claim 1, further including a cover assembly, wherein the cover assembly includes:

a first fixed cover, the first fixed cover being fixedly mounted relative to the first mounting surface;

a first pivot cover, the first pivot cover being pivotally mounted relative to the first mounting surface;

a second fixed cover, the second fixed cover being fixedly mounted relative to the second mounting surface; and a second pivot cover, the second pivot cover being pivotally mounted relative to the second mounting surface.

11. The shower rod of claim 1, wherein:

as the rod assembly moves between the first position and the second position, the rod assembly pivots about an axis that is perpendicular to the plane in which the rod assembly lies; and as the rod assembly moves between the first position and the third position, the rod assembly pivots about an axis that is perpendicular to the plane in which the rod assembly lies.

12. The shower rod of claim 11, wherein:

as the rod assembly moves between the first position and the second position, the first rod portion pivots about a first vertical axis and the second rod portion pivots about a second vertical axis while the rod assembly lies in the common horizontal plane; and as the rod assembly moves between the first position and the third position, the first rod portion pivots about the first vertical axis and the second rod portion pivots about the second vertical axis while the rod assembly lies in the common horizontal plane.

13. The shower rod of claim 1, wherein:

when the rod assembly moves from the first position to the second position, an overall length of the rod assembly increases; and when the rod assembly moves from the first position to the third position, the overall length of the rod assembly increases.

14. The shower rod of claim 13, wherein:

when the rod assembly is in the second position and the third position, the overall length of the rod assembly is approximately the same.

15. The shower rod of claim 1, wherein:

when the rod assembly moves from the first position to the second position, an overall shape of the rod assembly changes; and when the rod assembly moves from the first position to the third position, the overall shape of the rod assembly changes.

16. The shower rod of claim 15, wherein:

when the rod assembly is in the second position and the third position, the overall shape of the rod assembly is approximately the same.

17. A shower rod, comprising:

a rod assembly, including:

a first rod portion, the first rod portion being flexible; and a second rod portion, the second rod portion being flexible, the second rod portion being operable to slide relative to the first rod portion;

a first mount/pivot assembly, including:

a first mount portion, the first mount portion being operable to fixedly mount to a first mounting surface; and a first pivot portion, the first pivot portion being operable to fixedly attach to the first rod portion, the first pivot portion being operable to pivot relative to the first mount portion; and a second mount/pivot assembly, including:

a second mount portion, the second mount portion being operable to fixedly mount to an opposed second mounting surface; and a second pivot portion, the second pivot portion being operable to fixedly attach to the second rod portion, the second pivot portion being operable to pivot relative to the second mount portion;

wherein the rod assembly is operable to move between a straight shape, a curved outward shape, and a curved inward shape;

wherein, when the rod assembly is in the straight shape, the first rod portion and the second rod portion are mounted relative to the first mount portion and the second mount portion in a first position;

wherein, when the rod assembly is in the curved outward shape, the first rod portion and the second rod portion are mounted relative to the first mount portion and the second mount portion in a second position;

wherein, when the rod assembly is in the curved inward shape, the first rod portion and the second rod portion are mounted relative to the first mount portion and the second mount portion in a third position;

wherein, as the rod assembly moves between the first position and the second position, the rod assembly pivots about an axis that is perpendicular to the plane in which the rod assembly lies; and wherein, as the rod assembly moves between the first position and the third position, the rod assembly pivots about an axis that is perpendicular to the plane in which the rod assembly lies.

18. The shower rod of claim 17, wherein:

as the rod assembly moves between the first position and the second position, the first rod portion pivots about a first vertical axis and the second rod portion pivots about a second vertical axis while the rod assembly lies in the common horizontal plane; and as the rod assembly moves between the first position and the third position, the first rod portion pivots about the first vertical axis and the second rod portion pivots about the second vertical axis while the rod assembly lies in the common horizontal plane.

19. A shower rod, comprising:

a rod assembly, including:

a first rod portion, the first rod portion being flexible; and a second rod portion, the second rod portion being flexible, the second rod portion being operable to slide relative to the first rod portion;

a first mount/pivot assembly, including:

a first mount portion, the first mount portion being operable to fixedly mount to a first mounting surface; and a first pivot portion, the first pivot portion being operable to fixedly attach to the first rod portion, the first pivot portion being operable to pivot relative to the first mount portion; and a second mount/pivot assembly, including:

a second mount portion, the second mount portion being operable to fixedly mount to an opposed second mounting surface; and a second pivot portion, the second pivot portion being operable to fixedly attach to the second rod portion, the second pivot portion being operable to pivot relative to the second mount portion;

wherein the rod assembly is operable to move between a straight shape, a curved outward shape, and a curved inward shape;

wherein, when the rod assembly is in the straight shape, the first rod portion and the second rod portion are mounted relative to the first mount portion and the second mount portion in a first position;

wherein, when the rod assembly is in the curved outward shape, the first rod portion and the second rod portion are mounted relative to the first mount portion and the second mount portion in a second position;

wherein, when the rod assembly is in the curved inward shape, the first rod portion and the second rod portion are mounted relative to the first mount portion and the second mount portion in a third position;

wherein, when the rod assembly moves from the first position to the second position, an overall length of the rod assembly increases;

wherein, when the rod assembly moves from the first position to the third position, the overall length of the rod assembly increases; and wherein, when the rod assembly is in the second position and the third position, the overall length of the rod assembly is approximately the same.

20. The shower rod of claim 19, wherein:

when the rod assembly moves between the first position and the second position, an overall shape of the rod assembly changes;

when the rod assembly moves between the first position and the third position, the overall shape of the rod assembly changes; and when the rod assembly is in the second position and the third position, the overall shape of the rod assembly is approximately the same.

* * * * *